US007228968B1

(12) United States Patent
Burgess

(10) Patent No.: US 7,228,968 B1
(45) Date of Patent: Jun. 12, 2007

(54) STICK-ON, FLEXIBLE, PEEL AND SEAL PACKAGE DISPENSER

(75) Inventor: Mark H. Burgess, Wausau, WI (US)

(73) Assignee: Starliner, LLC, Wittenberg, WI (US)

( * ) Notice: Subject to any disclaimer, the term of this patent is extended or adjusted under 35 U.S.C. 154(b) by 112 days.

(21) Appl. No.: 10/942,217

(22) Filed: Sep. 16, 2004

(51) Int. Cl.
*B65D 73/00* (2006.01)
*B65D 33/16* (2006.01)
*B65H 1/00* (2006.01)

(52) U.S. Cl. ..... 206/494; 206/233; 206/806; 206/812; 206/813; 221/63; 383/66

(58) Field of Classification Search ..... 206/494, 206/449, 205, 210, 233, 460, 806, 812, 813; 221/63; 383/9, 66
See application file for complete search history.

(56) References Cited

U.S. PATENT DOCUMENTS

| | | | | |
|---|---|---|---|---|
| 2,287,581 | A * | 6/1942 | Walker | 206/806 |
| 2,925,675 | A * | 2/1960 | Lumpkin | 206/813 |
| 3,109,578 | A | 11/1963 | Davis | |
| 3,306,492 | A * | 2/1967 | Kugler | 221/63 |
| 3,456,844 | A * | 7/1969 | Planner | 221/63 |
| 3,508,700 | A | 4/1970 | Kelly | |
| 3,554,435 | A * | 1/1971 | Martinez | 383/9 |
| 4,420,080 | A * | 12/1983 | Nakamura | 206/494 |
| 4,840,270 | A * | 6/1989 | Caputo et al. | 206/449 |
| 5,031,772 | A * | 7/1991 | Woodriff | 206/813 |
| 5,161,687 | A * | 11/1992 | Kornell et al. | 206/447 |
| 5,242,057 | A | 9/1993 | Cook et al. | |
| 5,511,883 | A | 4/1996 | Clark et al. | |
| 5,531,325 | A * | 7/1996 | Deflander et al. | 206/494 |
| 5,551,612 | A | 9/1996 | Hochfeld | |
| 5,657,870 | A | 8/1997 | Schottle et al. | |
| 6,113,271 | A * | 9/2000 | Scott et al. | 206/494 |
| 6,347,703 | B1 | 2/2002 | Betts | |
| 6,364,112 | B1 | 4/2002 | Pitschka | |
| 2003/0085565 | A1 | 5/2003 | Asay | |

* cited by examiner

*Primary Examiner*—Bryon P. Gehman
(74) *Attorney, Agent, or Firm*—Andrus, Sceales, Starke & Sawall, LLP

(57) ABSTRACT

A stick-on, flexible peel and seal, wet wipes package includes a flexible package body having a front surface, a rear surface, and an internal space sized to contain a plurality of removable wet wipes. An elongated opening extends through the package body to the internal space for accessing and permitting dispensing of the removable wet wipes. A substantially self-closing, resealable label flap is positioned on the front surface of the package body to cover the opening formed therein. The label flap has a bottom surface provided with a sealing adhesive that creates a seal entirely around the periphery of the opening and permits repeated application and removal of the label flap relative to the package body. The label flap further has a starting tab non-adhesively positionable in contact with the front surface of the package body. An adhesive layer structure is provided on the rear surface of the package body for adhering the package body to a support surface. A removable peel-off release layer structure covers and protects the adhesive layer structure prior to use thereof. The package body and the adhesive layer structure are removable from the support surface following emptying of the wet wipes from the package body.

8 Claims, 3 Drawing Sheets

FIG. 4
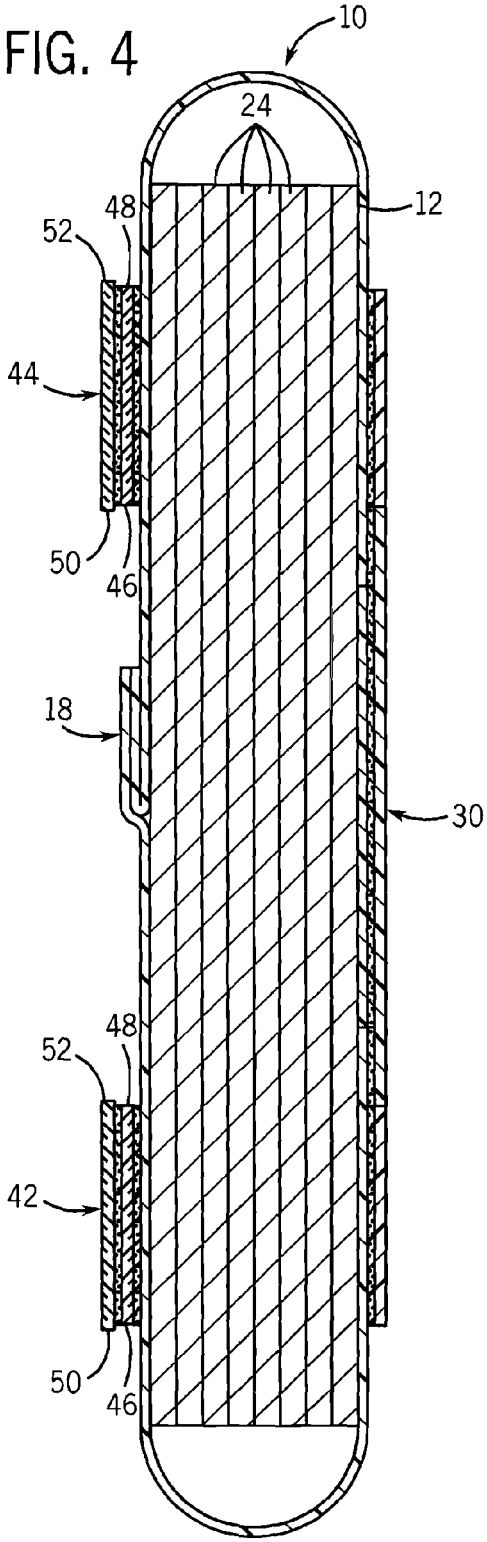
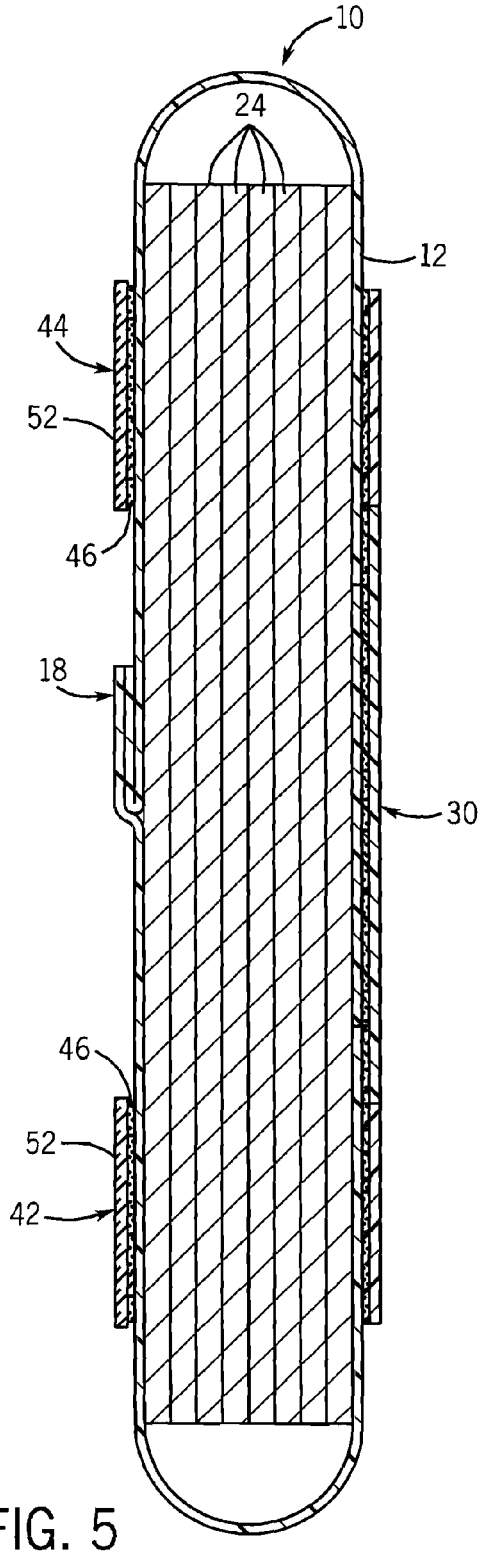
FIG. 5

STICK-ON, FLEXIBLE, PEEL AND SEAL PACKAGE DISPENSER

FIELD OF THE INVENTION

The present invention relates generally to flexible packaging of wet wipes in peel and seal packages, and more particularly, pertains to a stick-on, resealable, throwaway package that can be adhered to a variety of surfaces to enable the wet wipes to be readily dispensed.

BACKGROUND OF THE INVENTION

Resealable label flaps of peel and seal labels are commonly used with flexible product packages that include packaged sheet-like removable articles or wipes that have been thoroughly wetted with a liquid prior to packaging. The product packages are generally constructed from a thin, liquid-impervious material that has an opening over which the label flap is removably adhered. Typically, the label flap is a strip of flexible film or semi-rigid thermoplastic material having a removable pressure-sensitive adhesive applied to one surface of the label. The removable adhesive creates a generally air-tight seal around the package opening to prevent the packaged wet wipes from drying out during storage.

Although flexible peel and seal packages provide easy and ecologically friendly disposal, such packages can present difficulty in dispensing of the wet wipes and resealing of the label flap. If the label flap is incorrectly positioned or not reapplied, the wet wipes contained within the package are vulnerable to contamination and may eventually dry out thus reducing the product's effective life. Such dispensing and label resealing problems stem, in part, from the fact that the packages are not properly and efficiently fixed or mounted in place during dispensing such that a user must manipulate one's hands to hold the package, open the label flap, extract the wet wipe, and then reseal the label flap.

Accordingly, there remains a need to provide flexible peel and seal dispensing packages with a convenient and strong mounting structure to a support surface in a manner that improves the ease of dispensing, resealing, and locating the wet wipes. Such mounting structure should be designed so that it does not impair the printed graphics and text on the flexible package prior to the mounting process.

SUMMARY OF THE INVENTION

It is a general object of the present invention to provide a mounting structure that allows a flexible peel and seal package of wet wipes to be used as a dispenser.

It is also an object of the present invention to provide a rear surface of a flexible peel and seal package containing removable wetted articles with a transparent adhesive fastening arrangement having adhesive strips.

It is another object of the present invention to provide a wall-mountable, flexible peel and seal package that enhances the efficiency of dispensing, resealing, and locating the contents of the package.

In one aspect of the invention, a stick-on, flexible peel and seal, wet wipes package dispenser includes a flexible package body having a front surface, a rear surface and an internal space sized to contain a plurality of removable wet wipes. An elongated opening extends through the package body to the internal space for accessing and permitting the dispensing of the removable wet wipes. A substantially self-closing, resealable label flap is positioned on the front surface of the package body to cover the opening formed therein. The label flap extends between a first label end and a second label end and is sized to cover the opening in the package body. The label flap has a bottom surface provided with a sealing adhesive that creates a seal entirely around a periphery of the opening and permits repeated application and removal of the label flap relative to the package body. The label flap further has a starting tab non-adhesively positionable in contact with the front surface of the package body. An adhesive layer structure is provided on the rear surface of the package body for adhering the package body to a support surface. A removable peel-off release layer structure covers and protects the adhesive layer structure prior to use thereof. The package body and the adhesive layer structure are removable from the support surface following emptying of the wet wipes from the package body.

In the preferred embodiment, the adhesive layer structure and the peel-off release layer structure are transparent to permit the full readability of printed indicia on the package body. The package body has a top heat seal and a bottom heat seal, and the starting tab on the label flap is oriented towards the top heat seal. In one version, the adhesive layer structure includes a pair of spaced apart, double-sided, flexible substrates. Each substrate has a first adhesive layer on one surface of the substrate adhered to the rear surface of the package body, and a second adhesive layer on the opposite surface of the substrate covered by the peel-off release layer structure. The second adhesive layers are securable to the support surface upon removal of the peel-off release layer structure. In another version, the adhesive layer structure includes a pair of spaced apart adhesive strips applied directly to the rear surface of the package body. Each of the adhesive strips is covered by the peel-off release layer structure. The adhesive strips are securable to the support structure upon removal of the peel-off release layer structure. The adhesive layer structure and the peel-off release layer structure run generally longitudinally and in parallel along the rear surface of the package body. The top heat seal is preferably formed with a hang hole. The label flap is constructed of a semi-rigid, spring back, plastic material.

Various other objects, features, and advantages of the invention will be made apparent from the following description taken together with the drawings.

BRIEF DESCRIPTION OF THE DRAWINGS

The drawings illustrate the best mode presently contemplated of carrying out the invention.

In the drawings:

FIG. 4 is a sectional view taken on line 4—4 of FIG. 3; and

FIG. 5 is a sectional view of an alternative type of mounting structure for the package dispenser.

DETAILED DESCRIPTION OF THE INVENTION

Figure 1:
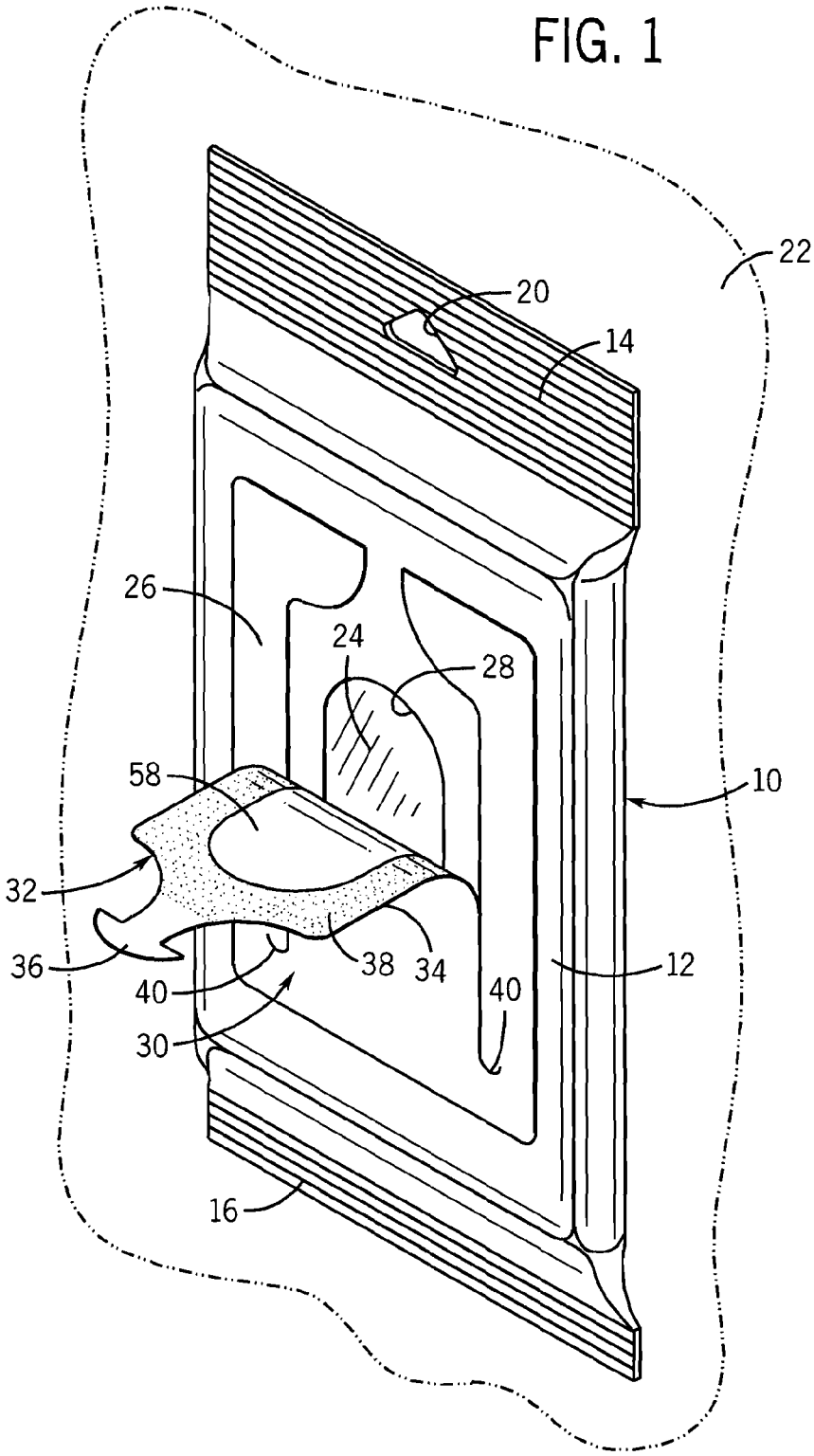
FIG. 1 is a perspective view of a stick-on, peel and seal flexible package dispenser adhesively fastened to a support surface in accordance with the present invention and showing a resealable label flap pulled back to access the contents of the package.
Figure 3:
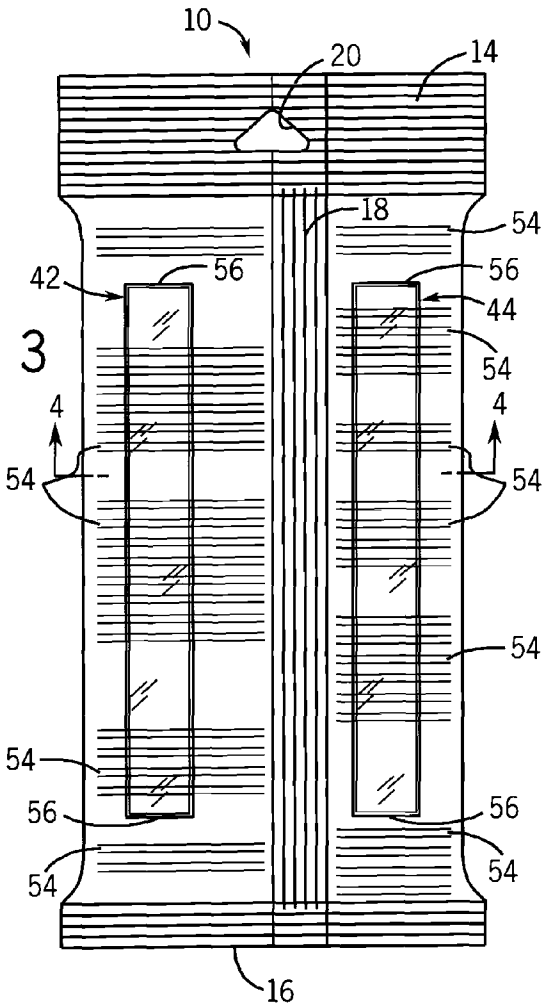
FIG. 3 is a rear view of the package of FIG. 1 illustrating one type of mounting structure for the package.
Figure 2:
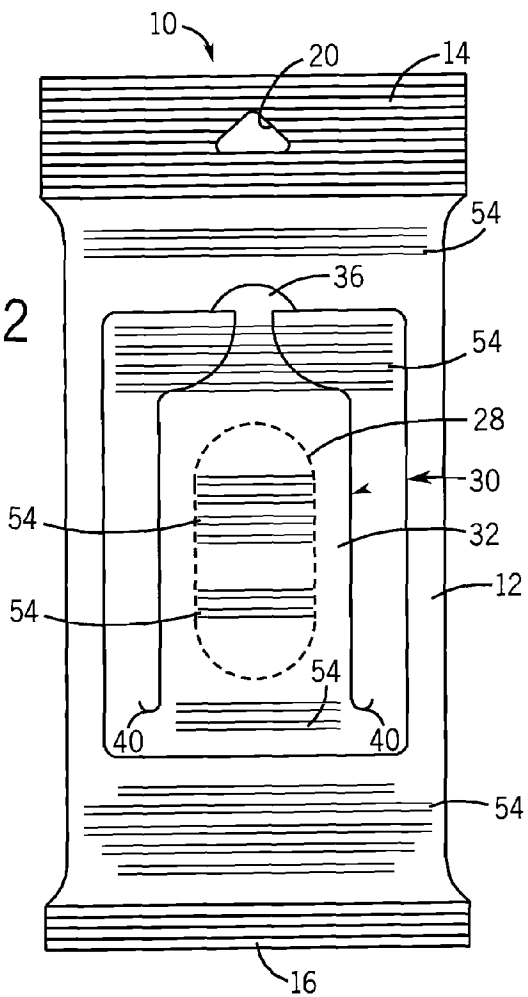
FIG. 2 is a top or front view of the package of FIG. 1 with the label flap in a closed position.

FIGS. 1–3 generally illustrate a wall-mountable, resealable product package dispenser 10 having a main package body 12 formed from a liquid-impervious flexible film material. The body 12 is provided with a top heat seal 14, a bottom heat seal 16, and a rear heat seal 18 to define an internal space for housing the removable articles contained within the product package dispenser 10. In the preferred embodiment, a central portion of the top heat seal 14 is provided with a hole 20 for suspending the package dispenser 10 from a rod or the like at a point of purchase before the package dispenser 10 is mounted on a wall or other support surface 22 in accordance with the present invention. However, it should be understood that the dispenser 10 does not necessarily require the hole 20 to be formed therein. In the embodiments of the invention illustrated, the contents of the product package dispenser 10 include a series of stacked, individual, non-woven wipes 24 impregnated with appropriate solutions. For example, the wipes 24 could be wetted baby wipes, hand towels, or body cleansing towels.

The package body 12 includes a continuous solid perimeter 26 forming an opening 28 through the package body 12 to provide access to the internal space containing the wipes 24. As can be readily understood, the individual wipes 24 can be removed from the internal space defined by the package body 12 through the opening 28.

The product package dispenser 10 further includes a semi-rigid peel and seal label 30 having a substantially self-closing, resealable, integral label flap 32 that is applied to the package body 12 to seal the package body 12 by covering the opening 28. The label flap 32 contacts the generally smooth, flat top surface of the package body 12 and forms a generally water-and air-tight seal with the package body 12 completely around the opening 28. The water-and air-tight seal around the opening 28 prevents contamination of the wipes 24 and prevents the wipes 24 from drying out.

The label flap 32 is resealably attached to the package body 12 such that the label flap 32 can be repeatedly opened and resealed to provide access to the wipes 24 contained within the internal space defined by the package body 12.

As can be seen in FIGS. 1 and 2, the label flap 32 includes a main body portion 34 and an integrally formed starting tab 36. In general, a bottom surface of the main body portion 34 includes a removable adhesive 38 that allows the label flap 32 to be repeatedly peeled from the package body 12 and reapplied thereto in order to gain access to the opening 28 and then reseal the product package dispenser 10. The resealable adhesive 38 contained on the main body portion 34 generally retains its adhesive properties during repeated application and removal of the main body portion 34 relative to the package body 12. The label flap 32 is constructed of a resilient material, such as polypropylene, and is connected at 40 to an outer portion of the peel and seal label 30 such that it has a tendency to spring back and self close towards the package body 12 after the label flap 32 has been opened and released. The connections 40 define a functional stop point during peeling of the label flap 32 from the package body 12 to access the wipes 24.

The starting tab 36 is a portion of the label flap 32 in which adhesive 38 on the label flap 32 is rendered ineffective or, in the alternative, not present such that the starting tab 36 can be grasped by the user to pull the label flap 32 from the package body 12 and down and away from the package body 12.

In accordance with the present invention, the rear surface of the package body 12 is provided with a convenient, stick-on mounting structure for adhesively fastening the package dispenser 10 to the wall or other suitable support surface 22. Although FIG. 1 shows the support surface 22 as a vertical wall, it is noted that the support surface 22 may take various other forms as desired.

Referring to FIGS. 3–5, the rear surface of the package body 12 includes an adhesive fastening arrangement comprised of a pair of elongated, spaced apart, transparent adhesive strips 42, 44. Each of the strips 42, 44 extends substantially longitudinally along the rear of the package body 12 between the top heat seal 14 and the bottom heat seal 16. Because of pulling forces on the label flap 32 on the front of the dispenser 10, it has been found advantageous to position the adhesive strips 42, 44 on the rear of the dispenser 10 adjacent the top heat seal 14. Depending on the size of the package body 12, the number of wipes 24 contained therein, and the type of peel and seal label 30, the adhesive strips 42, 44 generally extend from ¾ to the full length between the top heat seal 14 and the bottom heat seal 16. The adhesive strips 42, 44 may be located in different locations, have different shapes and different lengths.

In one embodiment of the invention shown in FIG. 4, each of the adhesive strips 42, 44 include four layers. The first layer is an adhesive 46 that is attached directly to the rear of the flexible package dispenser 10. The second layer is a flexible substrate 48 to which the adhesives 46 are attached. The third layer is an adhesive 50 that is secured to an outer flexible substrate surface where the flexible package dispenser 10 is to be mounted. The final layer is a peel-off release layer 52 that protects the adhesive 50 prior to use. The two adhesive layers 46 and 50 may be different. The adhesive 46 that adheres to the flexible package dispenser 10 is chosen to restrict removal of the adhesive strips 42, 44 from the flexible package dispenser 10. The adhesive 50 by which the flexible package dispenser 10 is joined to the support surface 22 holds the flexible package dispenser 10 and also allows it to be removed without damage to the surface 22.

It is an important feature of the present invention that each of the four layers 46, 48, 50, 52 is transparent so that printed indicia 54 under the adhesive strips 42, 44 can be read prior to attaching the flexible package dispenser 10 to the support surface 22. That is, a prospective user of the package dispenser 10 is able to fully and unobtrusively view any and all printed text and graphics relating to the use, application, etc. of the package dispenser 10 before mounting same. Using transparent adhesive strips 42, 44 preserves the total visibility of the package dispenser exterior before the mounting thereof. The adhesive strips 42, 44 are connected to the material that creates the flexible package dispenser 10 at the time the opening 28 is cut, and the peel and seal label 30 is affixed to such material. Accordingly, the adhesive strips 42, 44 are already positioned at the time the flexible package dispenser 10 of wet wipes 24 is created.

In an alternative embodiment of the invention illustrated in FIG. 5, the adhesives 46 are applied directly to the rear of the material forming the flexible package dispenser 10 and then covered until use with peel-off release layers 52. In this embodiment, there is no flexible substrate 48 used in the adhesive strips 42, 44.

The flexible package dispenser 10 is attached to the support surface 22 by simply removing the peel-off release layers 52 and pressing the rear of the package dispenser 10 against the support surface 22. The peel-off release layers 52 have extended pull tab portions 56 to facilitate removal thereof.

In use, once the package dispenser 10 has been adhesively fastened to the support surface 22, the wipes 24 may be dispensed by pulling down and away with one hand on the starting tab 36 of the label flap 32 on the front of the package body 12 as shown in FIG. 1. Orienting the peel and seal label 30 as shown in FIG. 1 has less tendency to pull the dispenser 10 off the support surface 22. When the label flap 32 is pulled from the package body 12, an oval covering 58 on the bottom of the flap 32 separates from the body 12 to define the dispensing opening 28. Upon extracting the desired wipes 24 with another hand, the label flap 32 is released so that it springs back or is otherwise moved to the closed, sealed position shown in FIG. 2 to ensure that the wipes 24 are prevented from drying out and from being contaminated. Once all the wipes 24 have been dispensed, the package body 12 and adhesive 50 can be pulled away from the support surface 22 without inflicting damage thereto, and the package body 12 is then discarded.

While the invention has been described with reference to a preferred embodiment, those skilled in the art will appreciate that certain substitutions, alterations, and omissions may be made without departing from the spirit thereof. Accordingly, the foregoing description is meant to be exemplary only and should not be deemed to limit the scope of the invention set forth with the following claims.

I claim:

1. A stick-on, flexible peel and seal, wet wipes package dispenser comprising:

a flexible package body having a front surface, a rear surface, a top heat seal, a bottom heat seal and an internal space sized to contain a plurality of removable wet wipes;

an elongated opening extending through the package body to the internal space for accessing and permitting dispensing of the removable wet wipes;

a substantially self-closing, resealable label flap positioned on the front surface of the package body to cover the opening formed therein, the label flap having a longitudinal axis extending between a first label end and a second label end and sized to cover the opening in the package body, the label flap having a bottom surface provided with a sealing adhesive that creates a seal entirely around a periphery of the opening and permits repeated application and removal of the label flap relative to the package body, the label flap further having a starting tab non-adhesively positionable in contact with the front surface of the package body, the label flap being removable from the package body along the longitudinal axis; and a pair of spaced apart adhesive strips applied directly to the rear surface of the package body, the adhesive strips each extending substantially from the top heat seal to the bottom heat seal along parallel longitudinal axes oriented parallel to the longitudinal axis of the resealable label flap, each of the adhesive strips being covered by a peel-off release layer structure to protect the adhesive strips prior to use thereof, the adhesive strips being securable to the support structure upon removal of the peel-off release layer structure.

2. The package dispenser of claim 1, wherein the adhesive strips and the peel-off release layer structure are transparent to permit printed indicia on the package body to be read.

3. The package dispenser of claim 1, wherein the starting tab on the label flap is oriented towards the top heat seal.

4. The package dispenser of claim 3, wherein the top heat seal is formed with a hang hole.

5. The package dispenser of claim 1, wherein the adhesive strips each include a double-sided, flexible substrate, the substrate having a first adhesive layer on one surface of the substrate adhered to the rear surface of the package body, and a second adhesive layer on an opposite surface of the substrate covered by the peel-off release layer structure, the second adhesive layers being securable to the support surface upon removal of the peel-off release layer structure.

6. The package dispenser of claim 1, wherein the label flap is constructed of a semi-rigid, spring back, plastic material.

7. The package dispenser of claim 1 wherein the package body further includes a rear heat seal extending along the rear surface of the package body from the top heat seal to the bottom heat seal, wherein the pair of adhesive strips are applied to the rear surface of the package body on opposite sides of the rear heat seal.

8. The package dispenser of claim 7 wherein each of the adhesive strips are located adjacent a sidewall of the package body.

* * * * *